US008926059B2

(12) United States Patent
Justice et al.

(10) Patent No.: US 8,926,059 B2
(45) Date of Patent: Jan. 6, 2015

(54) PRINT HEAD CAPPING DEVICE AND PRINTER

(75) Inventors: Greg K. Justice, Vancouver, WA (US); Gene D. Jones, Yacolt, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/881,213

(22) PCT Filed: Oct. 27, 2010

(86) PCT No.: PCT/US2010/054201

§ 371 (c)(1), (2), (4) Date: Apr. 24, 2013

(87) PCT Pub. No.: WO2012/057741

PCT Pub. Date: May 3, 2012

(65) Prior Publication Data

US 2013/0215189 A1 Aug. 22, 2013

(51) Int. Cl.
*B41J 2/165* (2006.01)

(52) U.S. Cl.
CPC ..... *B41J 2/16511* (2013.01); *B41J 2/16508* (2013.01); *B41J 2/16585* (2013.01)
USPC ..... 347/29

(58) Field of Classification Search
None
See application file for complete search history.

(56) References Cited

U.S. PATENT DOCUMENTS

| | | | | |
|---|---|---|---|---|
| 5,936,647 | A | 8/1999 | Rhodes et al. | |
| 6,273,547 | B1 * | 8/2001 | Aldrich | 347/36 |
| 6,406,124 | B1 | 6/2002 | Davis | |
| 6,709,087 | B2 * | 3/2004 | Ansell et al. | 347/29 |
| 7,229,149 | B2 | 6/2007 | Wotton et al. | |
| 2006/0268049 | A1 | 11/2006 | Jung et al. | |
| 2010/0141704 | A1 | 6/2010 | Chun | |

FOREIGN PATENT DOCUMENTS

| | | |
|---|---|---|
| JP | 2005-193568 A | 7/2005 |
| JP | 2010221677 | 10/2010 |

* cited by examiner

*Primary Examiner* — Lamson Nguyen

(57) ABSTRACT

A print head capping device includes a flexible cap configured to engage with a print head, and a cap mount including a first portion and a second portion. The cap is mounted to the first portion and to the second portion. The first portion of the cap mount and the second portion of the cap mount are moveable with respect to each other.

15 Claims, 11 Drawing Sheets

$$h_2 = h_1 \frac{1}{4\cos\left(\frac{\theta}{8}\right)^2}$$

PRINT HEAD CAPPING DEVICE AND PRINTER

BACKGROUND

A print head, e.g. an inkjet print head, includes a reservoir holding the printing material, e.g. liquid ink. The print head further includes a plurality of nozzles being in fluid communication with the reservoir. The nozzles are provided at a surface of the print head and allow expelling the print material held in the reservoir onto a recording medium, e.g. a sheet of paper. During a print operation the print head and the recording medium move relative to each other for generating a desired print out, e.g. an image or text, on the recording medium by expelling the print material from the reservoir via the nozzles onto the recording medium.

When the printer including such a print head is inoperative the nozzles are not used. Leaving the nozzles in such an operating state unprotected may cause an interaction between the print material in the reservoir and the environment which may have a detrimental effect on the printing material, e.g. an ink, held in the reservoir. This interaction may cause a vapor transmission from the print material via the nozzles. In addition, the nozzles may be effected, e.g. by clogging due to dried print material particles.

To avoid such detrimental effects a printer is provided with a capping system that includes an elastomeric or flexible cap held by a support element. The cap can be brought into engagement with the print head to form a seal around the nozzles. Providing a cap on the print head in an idle state of the print head extends the life time and the reliability of the print head. To reliably seal the nozzles the cap is in a continuous engagement with a surface of the print head on which the nozzles are arranged so that leaks are avoided.

However, print heads and/or the cap support element may not be manufactured perfectly. The print head surface and/or the cap support element may not be perfectly straight, e.g. the print head surface and for the cap support element may have a curvature. The print head may have two ends along a dimension that are recessed when compared to a center part. In another case the center part of the print head may be recessed when compared to the ends along a dimension of the print head. This results in a bow or a curvature in the print head surface that needs to be compensated for by the elastomeric cap yielding a specific degree of compliance. However, such compliance of the cap material is finite. In case the bow or curvature becomes excessive, despite the compliance of the cap material a complete seal around the nozzles may no longer be achieved. In case the center part of the print head is recessed a leak in the seal at this part may occur as the cap rests tightly on the opposed ends of the print head and is compressed there, however, the compliance of the material is not sufficient to also allow for a tight seal at the central part of the print surface. This reduces the effects achievable by providing the cap around nozzles of a print head.

This problem may be encountered in any kind of print head, however, the larger the dimension of a print head and the larger the dimension of the cap for sealing the print head become, the more severe this problem becomes as manufacturing such elements in accordance with the desired tolerances becomes more difficult. For example, in a page width printer a print head or print bar is used that extends over the print area, e.g. over the width of a page to be printed. Such a print bar and the associated capping system may be made from long parts made of plastic and/or metal that are difficult to manufacture perfectly straight so that these parts may have a curvature which may not be compensated for by the elastomeric cap material so that the above mentioned leak in the seal may occur.

DESORPTION OF THE DRAWINGS

Figure 3A:
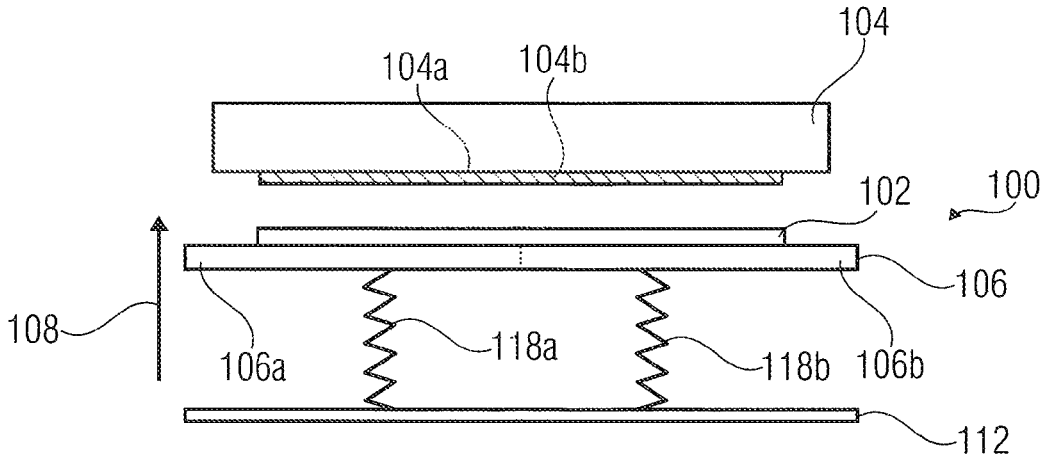
Figure 3B:
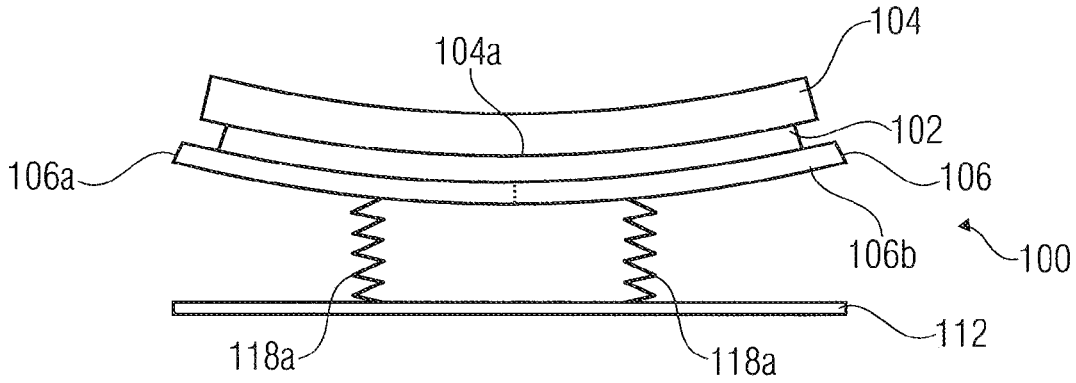
Figure 3C:
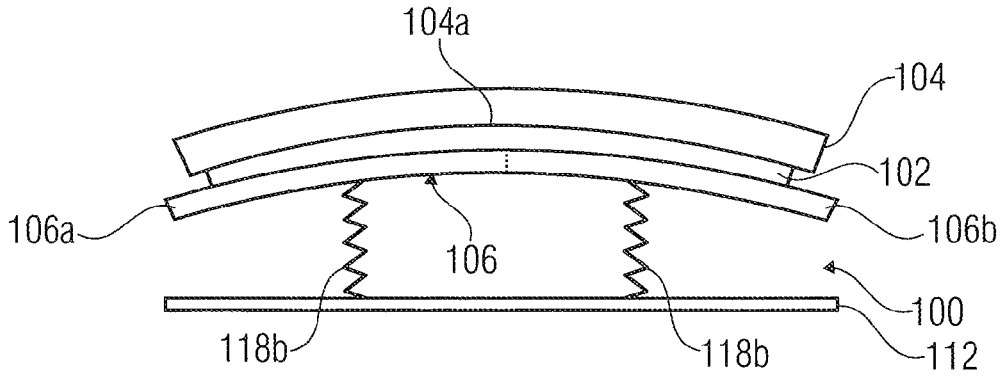
Figure 4A:
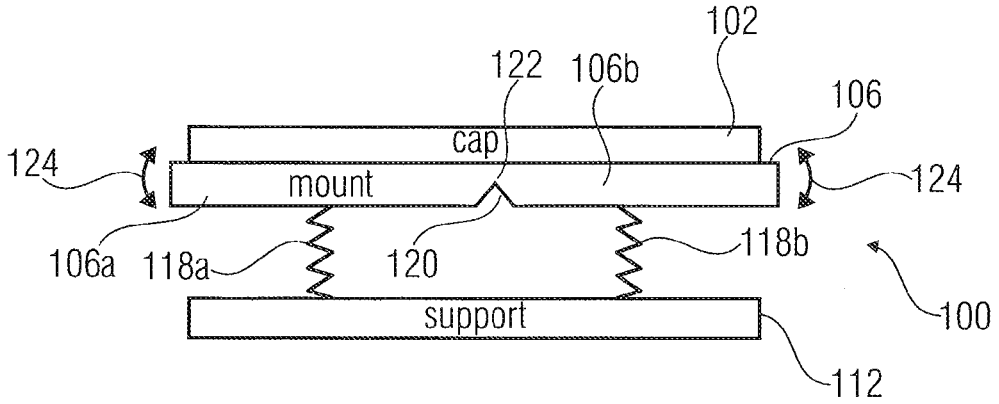
Figure 4B:
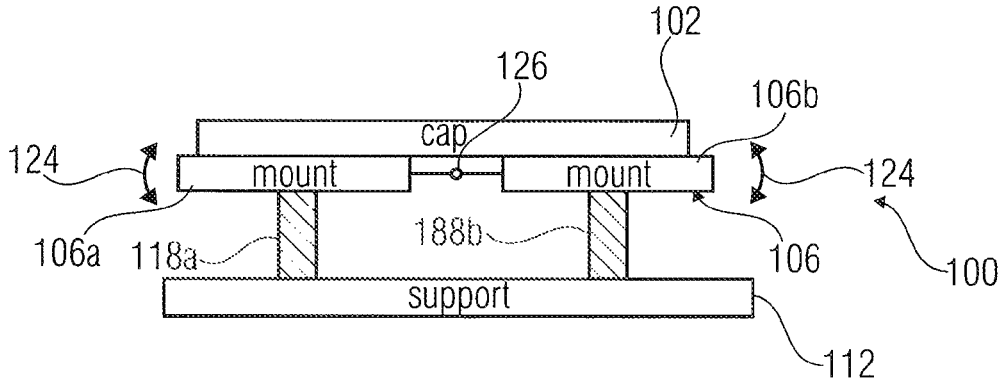
Figure 6:
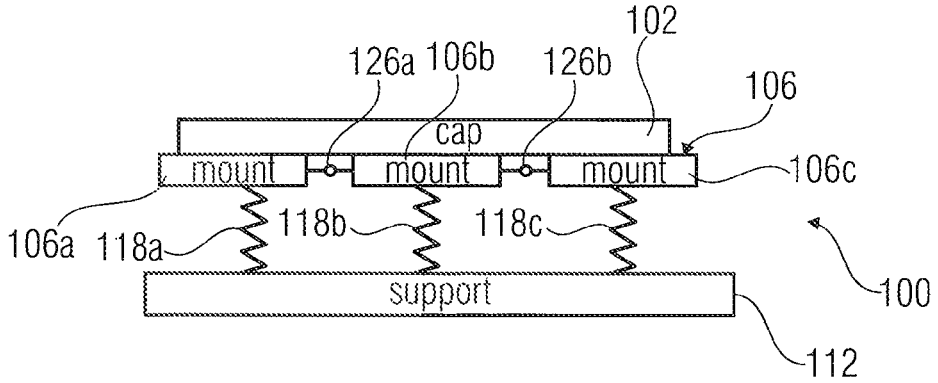
Figure 5:
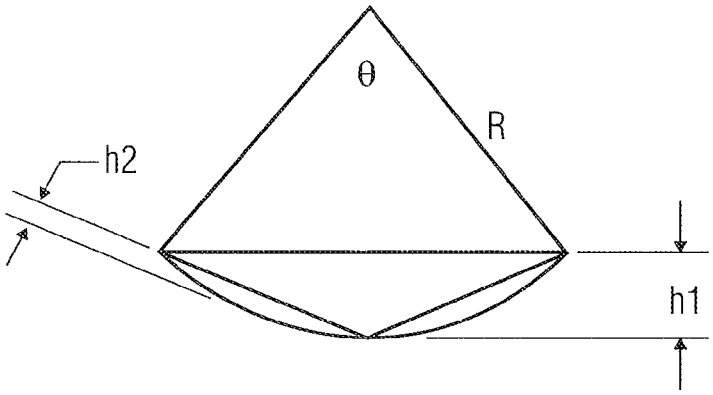
Figure 7:
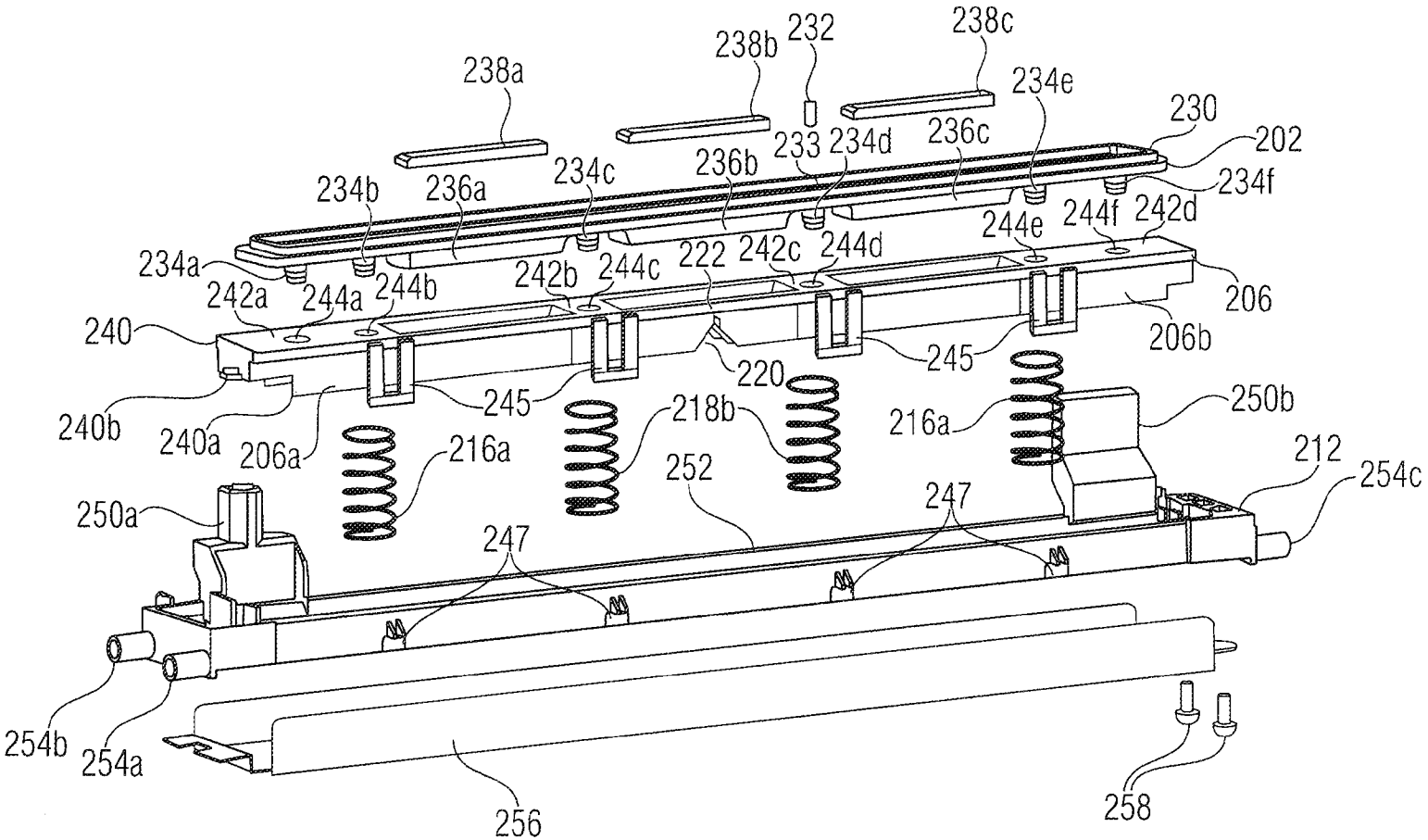
Figure 8:
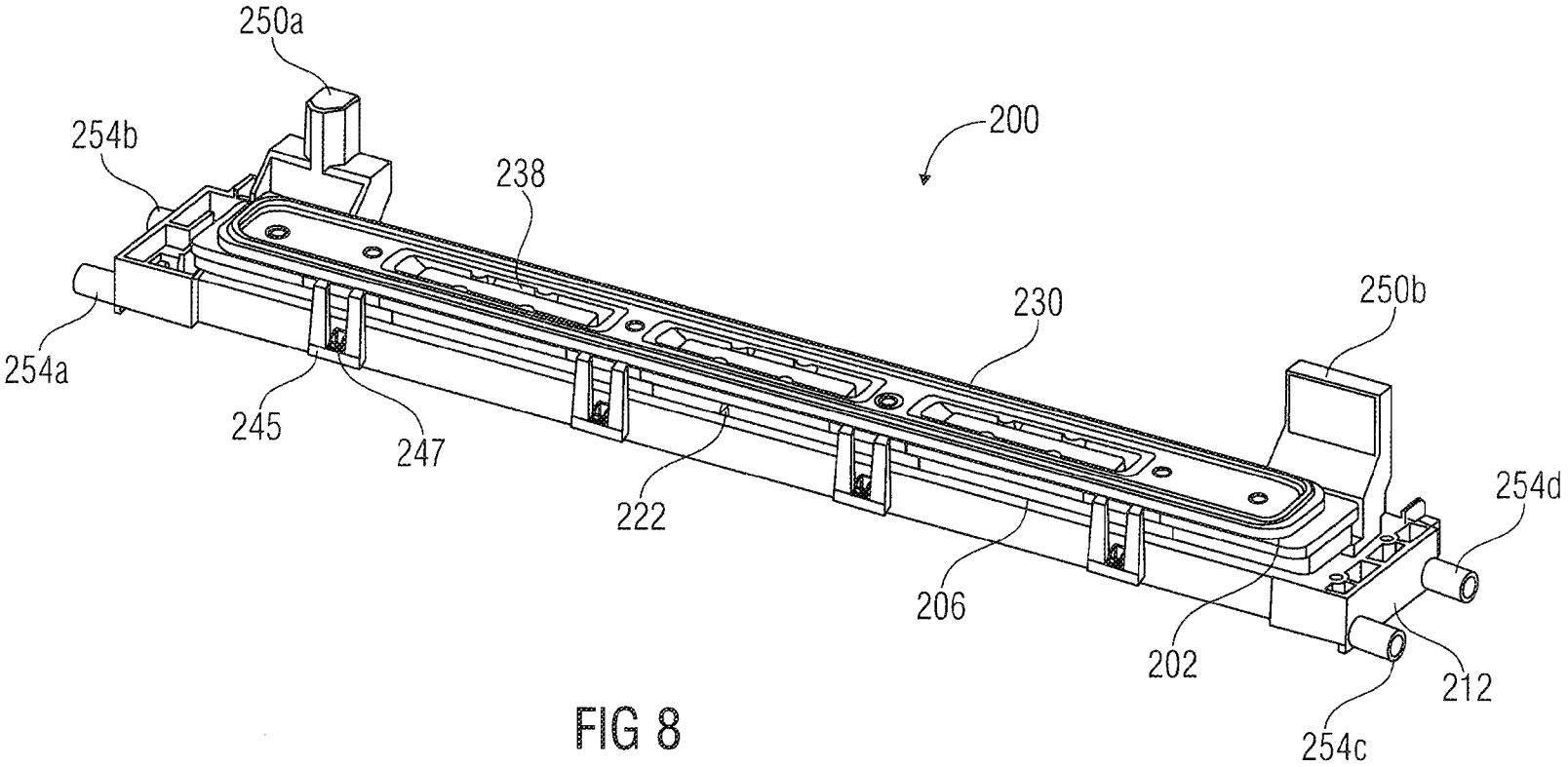
Figure 9:
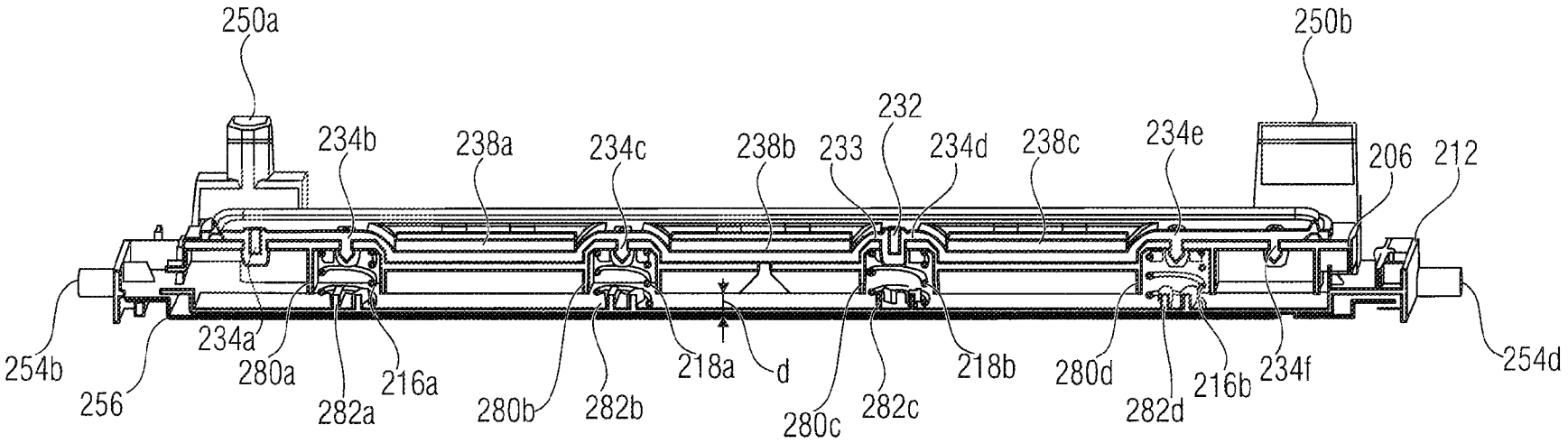
Figure 10A:
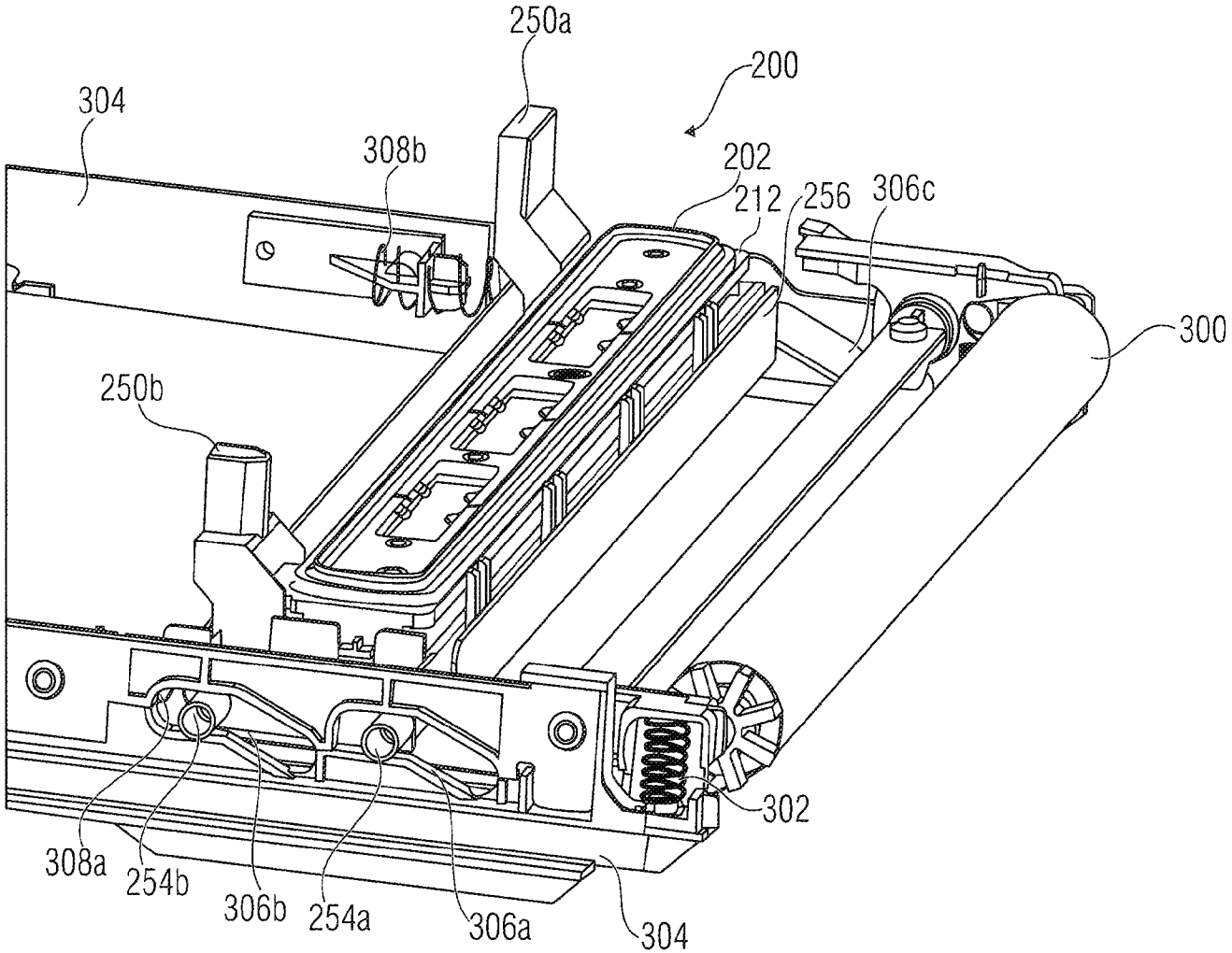
Figure 10B:
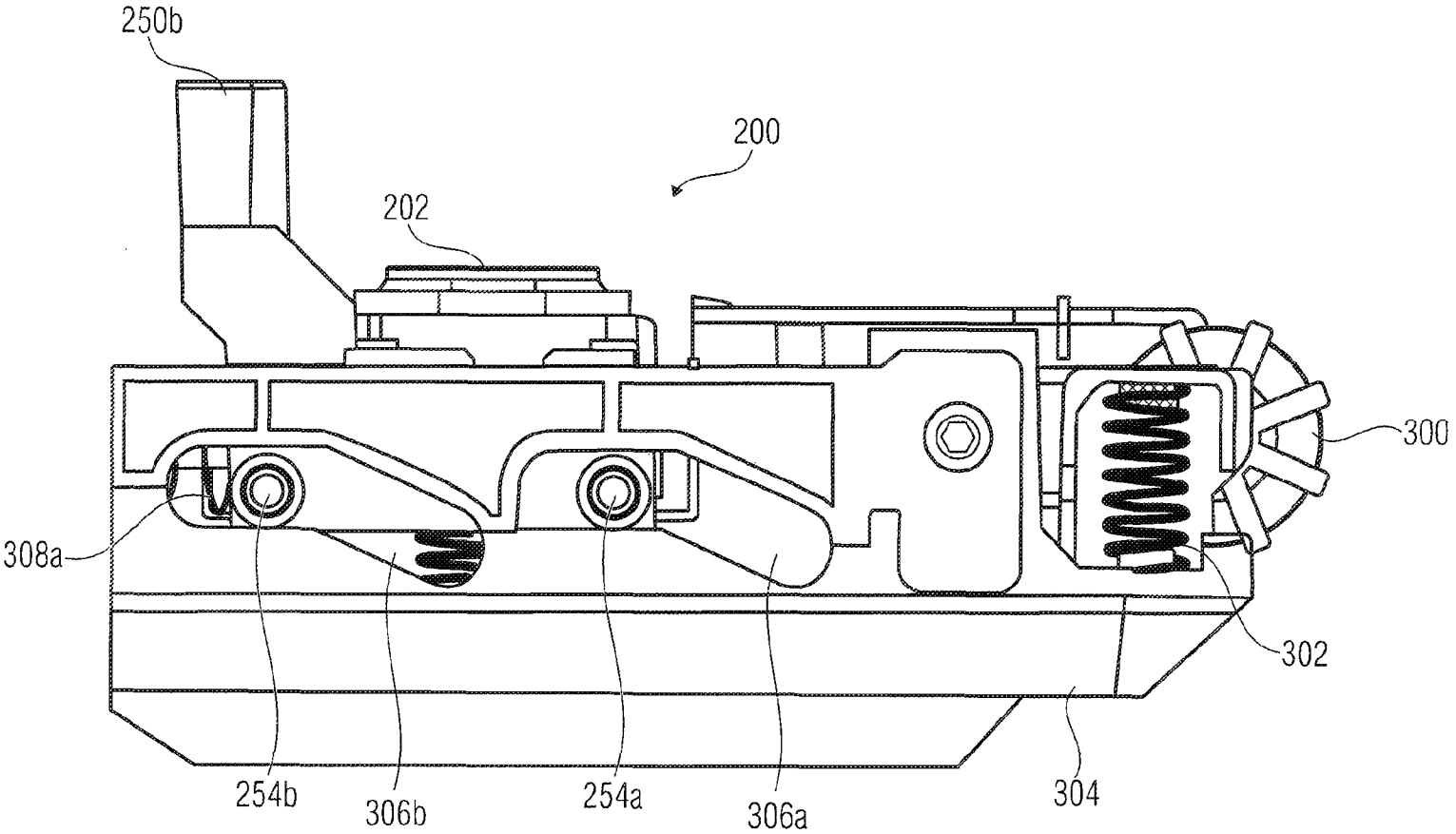
Figure 10C:
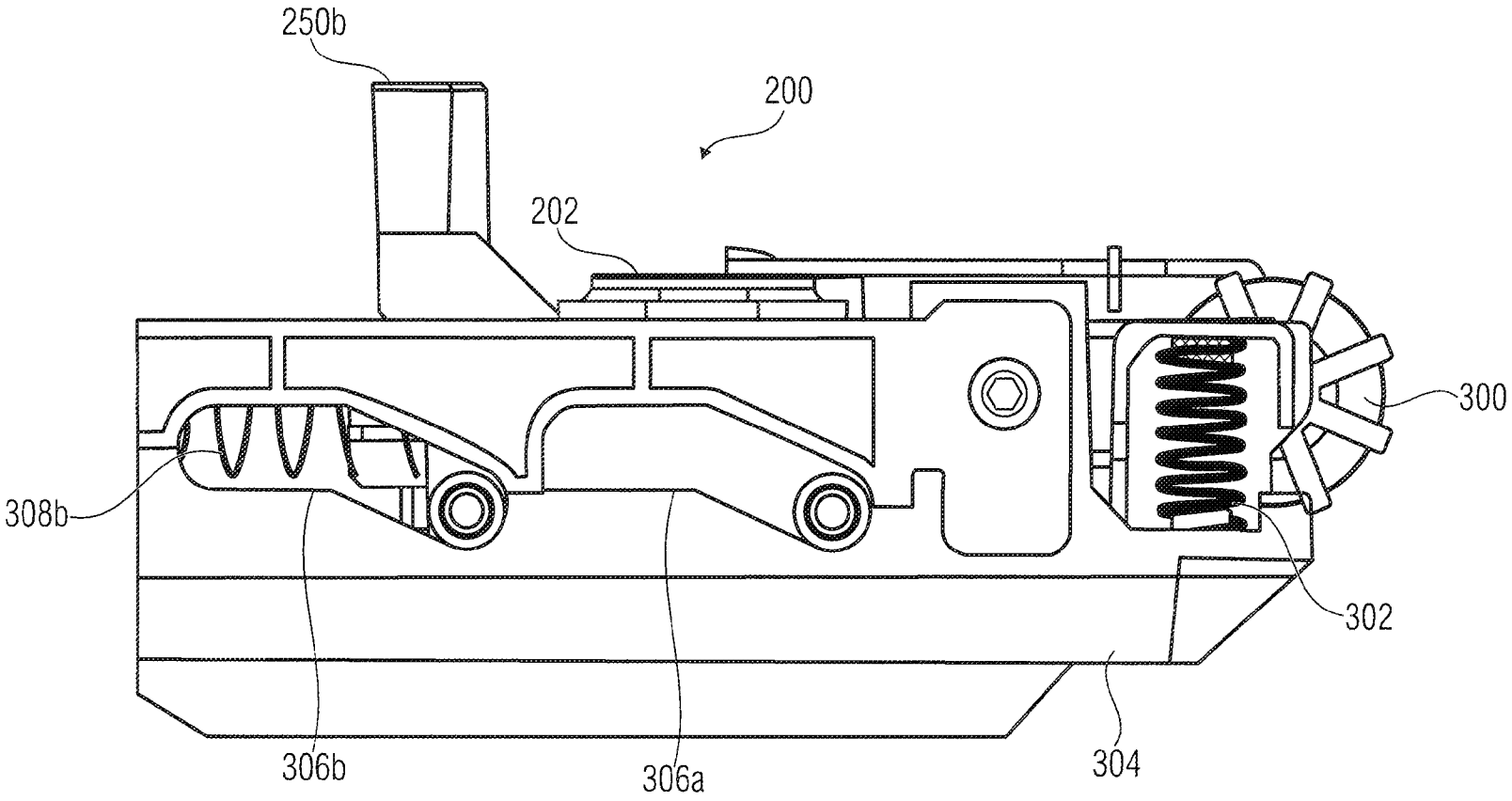

FIG. 3 shows another embodiment of a capping device and its functionality for capping a print head, FIG. 3(*a*) showing the capping device in a non-capping or rest position distant from the print head. FIG. 3(*b*) showing the capping device capping the print head having a surface bowed towards the capping device, and FIG. 3(*c*) showing the capping device capping the print head having a surface bowed away from the capping device;

FIG. 4 shows further embodiments of a capping device, FIG. 4(*a*) showing a capping device having a living hinge between the cap mount portions, and FIG. 4(*b*) showing a capping device having a mechanical hinge between the cap mount portions;

FIG. 5 shows a diagram for illustrating the advantages of the capping devices described in this specification when compared to devices not having an articulated cap mount;

FIG. 6 shows another embodiment of a capping device having a cap mount including three portions;

FIG. 7 shows an exploded view of another embodiment of a capping assembly;

FIG. 8 shows of the cap assembly of FIG. 7 in a mounted state;

FIG. 9 shows a cross-sectional view in the x-z plane of the mounted cap assembly of FIG. 8;

FIG. 10 shows schematic representations illustrating the movement of a cap assembly shown in FIGS. 7 to 9 between an at-rest position and a capped position, wherein FIG. 10(*a*) is an isometric view showing a part of a printer holding the cap assembly, FIG. 10(*b*) is a side view of the structure of FIG. 10(*a*) with the cap assembly at an elevated position, and FIG. 10(*c*) is a side view of the structure of FIG. 10(*a*)

Figure 11:
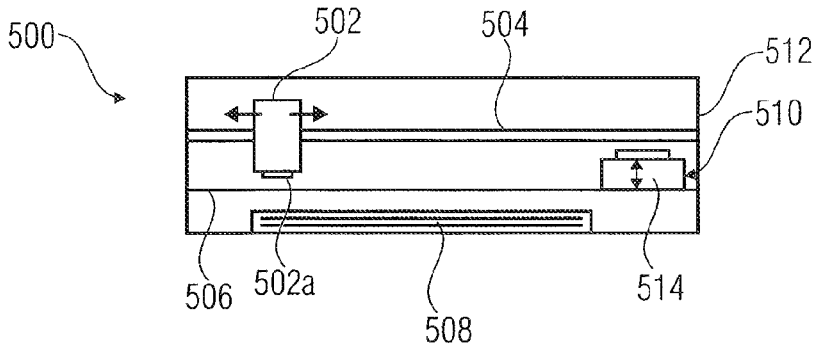
Figure 12A:
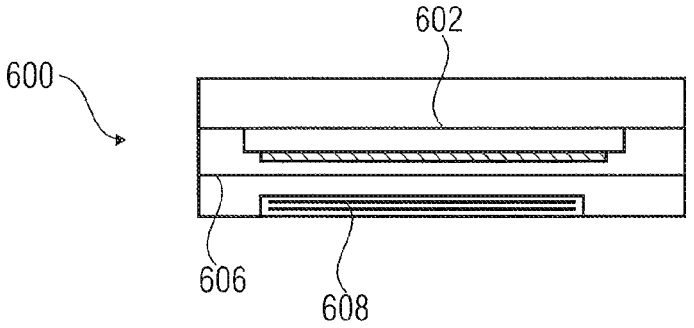
Figure 12B:
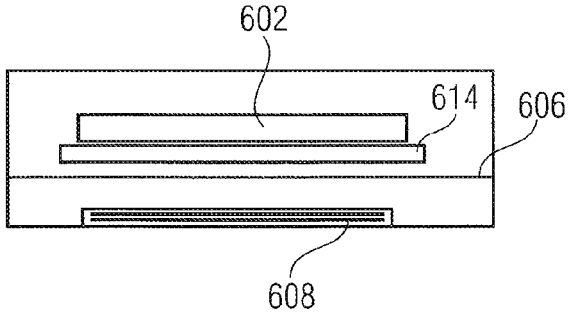

FIG. 11 shows an example of a printer in which a cap pin device in accordance with embodiments may be used; and FIG. 12 shows an example of another printer in which a capping device in accordance with embodiments may be used.

DETAILED DESCRIPTION

Embodiments relate to a capping device for a print head which includes a cap for engaging the print head to seal e.g. the nozzles of the print head and a cap mount supporting the cap. The capping device tolerates and compensates for a curvature of a print head surface and/or the cap mount by providing the cap mount to which the cap is attached with two portions that can be moved with respect to each other. This allows for the cap to be able to conform to a print head even in case the print head and/or the cap mount are not perfectly straight, e.g. show an excessive curvature. Thus, the capping device adds compliance to the cap in a way to accommodate for the imperfections of the manufacturing of the print head and/or the cap mount.

E.g. a long print bar assembly used in a page width printer may be difficult to manufacture in a completely straight manner. Also, parts of the cap device or assembly are long and may also be difficult to manufacture completely straight. This results in the above described problem as the cap may contact the print bar with a reliable seal at the center of the print head but not at its ends or vice versa. Arranging the cap on a cap support or mount having two portions that can be moved with respect to each other provides for an extra degree of freedom that allows the can to conform to the print bar even in case of a curvature. This also applies in case cap assembly parts, like the cap mount have a curvature.

Figure 1:
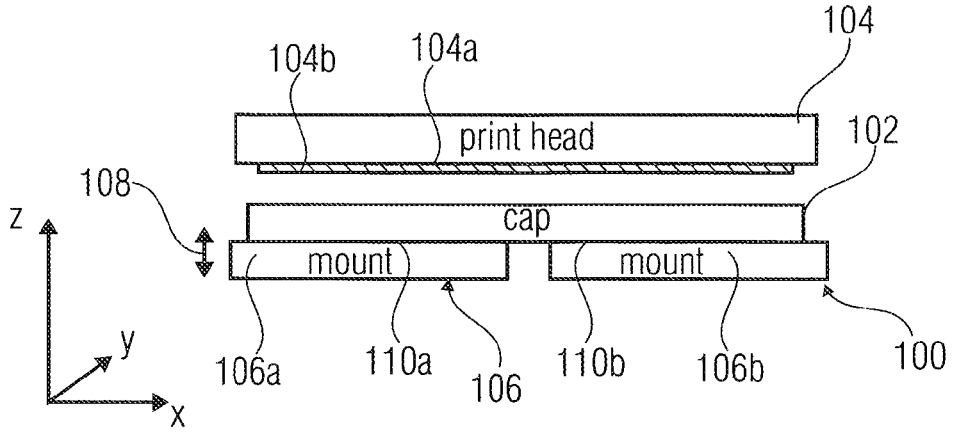
FIG. 1 illustrates an embodiment of a print head capping device.

FIG. 1 illustrates an embodiment of a print head capping device 100 that comprises a flexible cap 102 that is configured to engage a surface 104*a* of a print head 104. On the surface 104*a* the print head's nozzles 104*b* are arranged. The cap 102 is mounted to a cap mount 106 that includes a first portion 106*a* and a second portion 106*b*. The first and second cap mount portions 106*a* and 106*b* are moveable with respect to each other, as is indicated by the arrow 108. In accordance with an example of the capping device 100, the first and second cap mount portions 106*a* and 106*b* are moveable along at least one axis or direction (the z-direction in FIG. 1) extending through the cap 102 and the cap mount 106. The first and second cap mount portions 106*a* and 106*b* include respective surfaces 110*a* and 110*b* to which the cap 102 is mounted and which extends in the x-y plane. The capping device 100 is moveable between a first position (a non-capping position) as shown in FIG. 1 and a second position (the capping position). In the first position the cap 102 is not in engagement with the print head 104 and the nozzles 104*b* of the print head 104 are not sealed by the cap 102. In the second position the cap 102 engages the surface 104*a* of the print head 104 and provides the desired seal. To be moved between the capping position and the non-capping position the print head capping device 100 is moveable in the vertical direction, for example the z-direction. The first and second portions 106*a* and 106*b* of the cap mount 106 are moveable with respect to each other also at least along the z-direction.

Figure 2A:
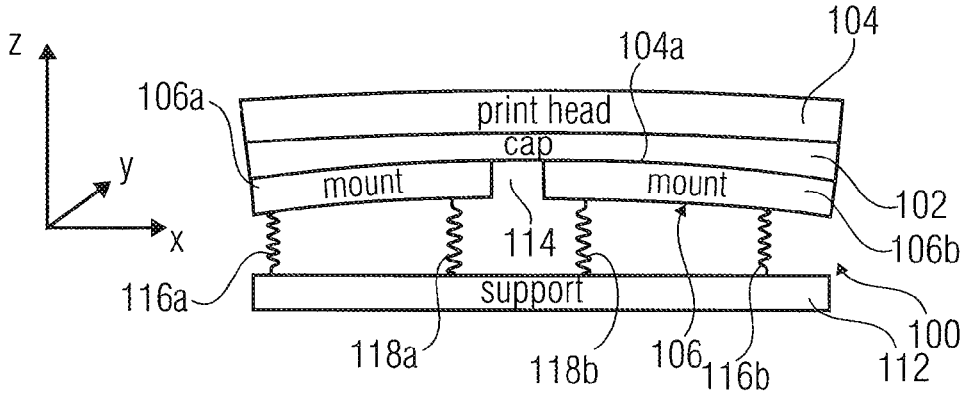
FIG. 2 shows the capping device of FIG. 1 compensating a curvature or bending in the surface of the print head, FIG. 2(*a*) showing a print head having a surface with a bending or bow in a direction away from the capping device, and FIG. 2(*b*) showing a print head having a surface with a bending or bow in a direction towards the capping device.
Figure 2B:
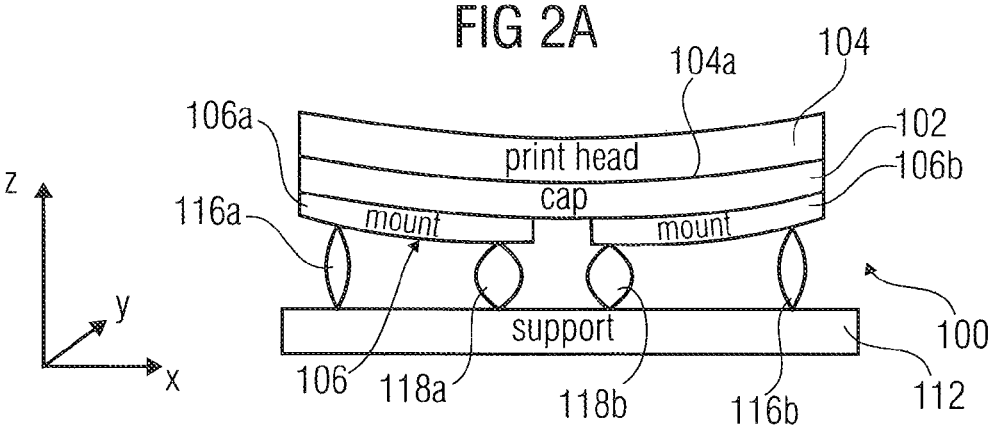

FIG. 2 shows examples of the capping device 100 for compensating a curvature or bending in the surface 104*a* of the print head 104. FIG. 2(*a*) shows a print head 104 having a surface 104*a* with a bending or bow in a direction away from the capping device 100. To be more specific, a distance between a central portion of the surface 104*a* and the capping device is larger than a distance between edge portions of the surface 104*a* and the capping device. In FIG. 2(*a*) the bending of the surface 104*a* is shown in an exaggerated scale to explain the functionality of the capping device 100. FIG. 2(*a*) shows the situation in which the capping device 100 was moved along the z-direction from the non-capping position (see FIG. 1) to the capping position in which the cap 102 engages the surface 104*a* of the print head 104. In the capping device 100 in accordance with the example shown in FIG. 2(*a*) the first and second cap mount portions 106*a* and 106*b* are resiliently supported by a support or gimbal plate 112 and are separated by a gap 114. The cap mount portions 106*a* and 106*b* have respective opposed ends along a dimension along the x-direction. First ends of the first and second cap mount portions 106*a* and 106*b* are arranged distant from the gap 112, and second ends are arranged proximate to the gap 114 and opposed to each other. The first cap mount portion 106*a* is mounted via a first resilient member 116*a* and a second resilient member 118*a* to the support plate 112. The first resilient member 118*a* is mounted near the first end of the first cap mount portion 106*a*, and the second resilient member 118*a* is mounted near the second end of the first cap mount portion 106*a*. The second cap mount portion 106*b* is supported in a similar manner by a first resilient member 116*b* near the first end and by a second resilient member 118*b* near the second end. The resilient members 116*a,b* and 118*a,b* may be springs, for example coil springs.

In the capping position shown in FIG. 2(*a*) the cap 102 engages the lower surface 104*a* of the print head 104 for sealing e.g. the nozzles 104*b* (see FIG. 1) of the print head 104. Upon engaging the print head surface 104*a* first ends (the outer ends along the x-direction) of the cap 102 contact an area of the print head 104 close to the outer ends (along the x-direction) of the print head 104. The print head 104 is at a fixed position so that due to the movement of the capping device 100 towards and into contact with the print head 104 the resiliently supported cap mount portions 106*a* and 106*b* move individually with respect to each other. In FIG. 2(*a*) this movement is shown in an exaggerated manner. The cap mount portions 106*a* and 106*b* are tilted with respect to each other, thereby allowing the cap 102 to conform better to the print head surface 104*a*. As the movement continues, also the center part of the cap 102 engages the center part of the print head 104 and the outer ends of the cap mount portions 106*a* and 106*b* are at a lower position than the inner ends so that the resilient members 116*a* and 116*b* are compressed more than the central resilient members 118*a* and 118*b*. Since the two cap mount portions 106*a* and 106*b* are moveable with respect to each other the capping device 100 allows the cap 102 to conform the to the bend surface 104*a* better without reaching a compliance limit so that the cap 102 reliably seals all desired portions of the print head 104.

FIG. 2(*b*) illustrates the functionality of the capping device 100 when capping a print head 104 having a surface 104*a* that is bend or bowed into the direction of the capping device 100. To be more specific, a distance between a central portion of the surface 104*a* and the capping device is smaller than a distance between edge portions of the surface 104*a* and the capping device. Again, the bending of the print head surface 104*a* is shown in an exaggerated manner. In the example shown in FIG. 2(*b*) the resilient members 116*a,b* and 118*a,b* are leaf springs which may also be used instead of the coil springs shown in the example in FIG. 2(*a*). Upon engaging the print head 104 by moving the capping device 100 from the rest position (see FIG. 1) against the surface 104*a* of the print head 104 the central part of the cap 102 engages a central part of the print head 104 first, so that the central resilient members 118*a* and 118*b* will be compressed first. Upon further moving the capping device 100 towards the print head surface 104*a* the outer edges of the cap 100 engage the outer edges of the print head 104 so that also the outer resilient members 116*a* and 116*b* will be compressed, however, other than in FIG. 2(*a*), the central resilient members 118*a* and 118*b* are compressed more than the outer resilient members 116*a* and 116*b*. The effect is the same as in FIG. 2(*a*), in that the cap 100 complies with the bend surface 104*a* of the print head 104, thereby ensuring a reliable sealing operation of the cap 100.

In FIG. 2 each of the cap mount portions 106*a* and 106*b* is resiliently supported by two resilient members 116*a,b* and 118*a,b*. Other examples may use a different number of resilient members, for example one resilient member for each cap mount portion or more than two resilient members for each cap mount portion, e.g. dependent on the dimension of the capping device. Also, other examples may use more than two cap mount portions, for example an additional, third cap mount portion or even more cap mount portions that are all moveable with respect to each other, thereby accommodating for print heads having a very long x-dimension.

FIG. 3 shows another embodiment of a capping device 100 and its functionality for capping a print head. FIG. 3(*a*) shows the capping device 100 in a non-capping or rest position distant from the print head 104. The capping device comprises a cap 102 mounted to a cap mount 106. The cap mount 106 is formed of a resilient material, like a thin metal plate or a thin plastic plate. The cap mount 106 is resilient such that after a deformation, e.g. due to the engagement with a curved print head surface 104*a*, it returns to its original unbend position. The cap mount 110 is supported by two resilient members 118*a* and 118*b* mounted between a support plate 112 and a first portion 106*a* and a second portion 106*b* of the cap mount 106. The cap 102 is attached to the cap mount 106 such that it is mounted both to the first portion 106*a* and to the second portion 106*b*. In FIG. 3(*a*) the print head 104 is schematically shown. For an engagement with the print head 104 the capping device 100 is moved in the direction indicated by arrow 108 towards the print head 104.

FIG. 3(*b*) shows the capping device 100 of FIG. 3(*a*) capping the print head 104 having a bowed surface 104*a* which is bowed towards the capping device in a similar way as shown in FIG. 2(*b*). Upon bringing the capping device into engagement with the print head 104 the central part of the cap 102 contacts the central part of the surface 104*a* of the print head 104 first. When the cap is in engagement with the entire surface 104*a* of the print head 104 the flexible cap mount 106 is bend such that the outer and of the two portions 106*a* and 106*b* are bend upward with respect to the center of the cap mount. The flexibility allows for accommodating the bowed surface. The sheet or mount 106 to which the cap 102 is mounted is bent upwardly at the outer ends or edges, thereby providing for compliance of the cap 100 and allowing a reliable sealing operation.

FIG. 3(*c*) shows the use of the capping device 100 of FIG. 3(*a*) for capping a print head 104 having a surface 104*a* being bowed away from the capping device. Like in the example depicted in FIG. 2(*a*), the cap 102 first engages the outer ends or periphery of the print head 104 thereby deflecting the flexible cap mount 106 downward at its outer ends, thereby allowing the central part of the cap 102 to engage the central part of the print head surface 104*a* and to provide for the compliance of the cap 100 so that a reliable sealing operation is achieved.

FIG. 4 shows further embodiments of a capping device 100. Other than in FIG. 2, the cap mount portions 106*a* and 106*b* are linked or joined with each other such that they can be moved with respect to each other. For example a living hinge or a mechanical hinge is arranged between the two portions 106*a* and 106*b*.

In FIG. 4(*a*) a capping device 100 is shown that includes the cap 102 and the cap mount 106 mounted via two resilient members 118*a* and 118*b* to the support plate 112. The cap mount 106 is a continuous element having provided at a center thereof a notch 120 reducing the thickness of the cap mount 106 thereby forming a "living hinge" 122. By means of the notch 120 the rigidity of the cap mount 106 is reduced in the central part thereof so that the first cap mount portion 106*a* and the second cap mount portion 106*b* provided on the two sides of the notch 120 and coupled by the living hinge 122 can be moved with respect to each other upwards and downwards as indicated by the arrows 124.

The capping device 100 makes the elastomeric cap seal 102 that is attached to the semi-rigid cap mount 106 to conform to a curved surface 104*a* of a print head 104 in a way as was described with regard to FIGS. 2 and 3.

FIG. 4(*b*) shows another embodiment of a capping device 100. Instead of providing a living hinge as shown in FIG. 4(*a*) the capping device of FIG. 4(*b*) includes a mechanical hinge 126 that connects the two portions 106*a* and 106*b* to allow for a movement with respect to each other in a similar way as described above. In FIG. 4(*b*) the two cap mount portions 106*a* and 106*b* are mounted to the support plate 112 by means of resilient members 118*a* and 118*b* that are different from the resilient members described in the examples no far. Instead of using spring like elements, also members formed from an elastomeric or flexible material, like rubber material or the like, may be used as resilient members. Other examples of capping devices may use various members for supporting the portions 106*a* and 106*b* in a resilient way on the support 112 to allow for the functionality described above.

The mechanical hinge may be formed of a plastic snap together hinge that allows motion about one axis, a plastic snap together hinge that allows motion about three axes like a ball hitch, a precision metal hinge that is fastened to or has overmolded platforms like 106*a* and 106*b*, or an elastomeric hinge that is fastened to or has overmolded platforms like 106*a* and 106*b*

The examples described in the specification operate in the same way in case the surface of the print head, the headland, is flat but the cap mount is curved. If the cap mount is hinged in a way as shown in FIG. 4, e.g. in its middle, the distance that the cap or cap seal has to deflect in order to conform to the surface of the print head is reduced. Thus, an advantage of an articulated cap mount is that it is able to conform to irregular or curved surfaces that a straight rigid cap mount would not be able to seal on. Indeed, if due to manufacturing difficulties the cap mount itself is not straight, which may be a problem with long plastic or metal parts, the articulated cap mount is also able to deflect at its joints and the cap seal is still able to conform to the headland surface and create a vapor tight seal around the nozzles of the print head. With reference to FIG. 5 the advantages of the capping devices described in this specification when compared to devices not having an articulated cap mount are described. FIG. 5 is a diagram in which R indicates the radius of curvature of a printer or print head, for example the surface 104*a* shown in FIGS. 2 and 3. Assuming a straight rigid cap mount, the cap seal has to deform by the distance h1 in order to seal on the curved surface. However, if the cap mount has a joint or a hinge in the middle or is mounted to two parts moveable with respect to each other the cap seal has to deform by the smaller distance h2. The relationship between h1, h2 and the angle θ is shown in FIG. 5. There is a linear relationship between h1 and h2 for a particular angle indicated in the equation given in FIG. 5. For example, if θ equals 90° (π/2) then h1 will be 3.85 times h2. For θ equal to 45° (π/4) h1 will be 3.96 times h2. As the angle θ becomes smaller, the ratio between h2 and h1 becomes 4 to 1.

FIG. 6 shows another embodiment of a capping device 100. The capping device is similar to the one shown in FIG. 4(*b*) except that the cap mount 106 comprises three portions 106*a* to 106*c*, each connected by a mechanical hinge 126*a*-126*b* and each supported by a resilient member 118*a* to 118*c* on the support 112. More specifically, in a similar way as shown in FIG. 4(*b*), the cap mount portions 106*a* and 106*b* are joined together by a mechanical hinge 126*a*. The cap mount portions 106*b* and 106*c* are joined together by a further mechanical hinge 126*b*. It is noted that other examples may use more than three cap mount portions hinged together. It is further noted that also in the capping devices described above in FIGS. 1 to 4 the cap mount 106 may be formed of/with more than two cap mount portions. E.g. the capping device shown in FIG.

4(*a*) may include a further notch thereby forming more than one living hinge and more than two portions for mounting the cap 102.

FIG. 7 shows another embodiment of a capping device or cap assembly 200 in an exploded view. The cap assembly 200 may be used for page width printers using print heads extending over the entire page width that can be printed by such a printer. The cap assembly 200 comprises an elastic cap 202 that may be formed from an elastomer material, like EPDM (EPDM=ethylene propylene diene monomer). The cap 202 is mounted to a cap mount 206 that may be formed from a plastic material, like PPO (PPO=polyphenylene oxide) or a flexible polypropylene material. In case the printer is an inkjet printer the materials for the cap assembly 200 that are likely to come into contact with the ink are formed from a material that is compatible with the ink used in the print head to be capped. The cap assembly 200 further comprises a support 212 by which the cap mount 206 with a cap 202 mounted thereto is resiliently supported. The cap mount 206 comprises a notch 220 defining the living hinge 222 so that the cap support or mount 206 comprises the first cap mount or support portion 206*a* formed on one side of the hinge 222 and the second cap mount or support portion 206*b* formed on the other side of the hinge 222. The first cap mount portion 206*a* is mounted to the support 212 via a first, cuter spring 216*a* and a second, inner spring 218*a*. Likewise, the second cap mount portion 206*b* is mounted to the support 206 via a first, outer spring 216*b* and a second, inner spring 218*b*.

The cap 202 comprises a seal lip 230 for creating a vapor tight seal around the nozzles provided on a surface of a print head with which the cap's lip 230 engages. To allow for a venting of the sealed space between the cap 202 and the print head a labyrinth vent screw 232 is placed into an opening 233 in the cap 202. The cap 202 further comprises protrusions 234*a*-234*f* extending from a lower surface (the surface opposite to the one on which the seal 230 is formed) of the cap 202. The protrusions 234*a* and 234*f* are arranged at opposite ends of the cap 202 with one further protrusion 234*b* and 234*e*, respectively, adjacent thereto. Further, the cap 200 comprises three recesses 236*a*-236*c* for receiving absorber strips 238*a* to 238*c*. The absorber strips receive ink that may be leaking from the print head. The first recess 236*a* is arranged between the protrusions 234*b* and 234*c*, the second recess 236*b* is arranged between the protrusions 234*c* and 234*d*, and the third recess 236*c* is arranged between the protrusions 234*d* and 234*e*. The protrusion 234*d* includes the opening 233 for receiving the vent screw 232.

The cap mount 206 is formed of a frame structure 240 having two parallel frame elements 240*a* and 240*b* which are connected with each ether by plate elements 242*a*-242*d* of which plate elements 242*a* and 242*b* are arranged at opposite ends of the frame structure 240 of the cap mount 206. The plates 242*c* and 242*d* have a smaller dimension than the outer plates and are provided on both sides of the hinge 222. The distance between the plates 242*a* and 242*c*, the distance between the plates 242*b* and 242*d* and the distance between the plates 242*c* and 242*d* as well as the distance of the frames 240*a* and 240*b* is such that the recesses 236*a*-236*c* of the cap 202 may be received and accommodated in the space defined between the plates and the frame elements. Further, the plates 242*a* to 242*d* comprise respective openings 244*a*-244*f* for receiving the protrusions 234*a*-234*f* formed at the lower side or surface of the cap 202.

The springs 216*a,b* and 218*a,b* are received between the two frames 240*a* and 240*b* in such a way that the upper ends are supported by the lower surfaces of the plates 242*a* to 242*d*.

The cap mount 206 further comprises clip elements 245 that engage with respective protrusions 247 on the support 212 when mounting the respective elements of the cap assembly 200 together.

The cap mount support plate 212 may be formed from a plastic material, for example from PPO with fiber glass. The support 212 receives the lower ends of the springs 216*a,b* and 218*a,b*. The support 212 further comprises two locating features 250*a* and 250*b* that interface with the print bar. Upon assembly of the elements 202, 206 and 212 the springs 216*a,b* and 218*a,b* are compressed and the cap mount 206 with the cap 202 mounted thereto is received in a recess 252 of the support 206. The clip elements 245 and the protrusions 247 act together such that stops are defined which limit a vertical movement of the cap mount 206. The cap mount 206 is arranged at a position inside the recess 252 in such a way that a predefined amount of vertical movement between the stop and a bottom of the recess 252 is allowed. This provides for the freedom of movement of the respective portions 206*a* and 206*b* of the cap mount 206 for accommodating curved surfaces of the print head. Also, the cap mount 202 may be accommodated inside the recess 252 in such away that a tilting of the cap mount around the x-axis and the y-axis is possible for allowing compensating any inclined arrangement of the print head around the just mentioned axis due to manufacturing or assembly tolerances. The support 212 further comprises four pins 254*a* to 254*d* for guiding of the cap assembly 200 in a way as shall be discussed below.

The cap assembly shown in FIG. 7 further comprises a stiffening plate 256 that may be mounted to the support 206 via screws 258. The plate 256 may be formed of a metal, for example steel. The plate 256 is provided for supporting to the element 212 that may be formed from plastic. The plate 256 receives the forces applied by the springs to the element 212 to avoid any damage of element 212.

FIG. 8 shows a view of a cap assembly 200 of FIG. 7 in a mounted state, with the stiffening plate 256 omitted.

FIG. 9 shows a cross-sectional view in the x-z plane of the mounted assembly of FIG. 8. The vent screw 232 is provided in the opening 233 of the protrusion 234*d* which is received by the opening 244*d* on the right side of the notch 220. The other openings 244*a*-244*c* and 244*e*-244*f* shown in FIG. 7 receive the protrusions 234*a*-234*c* and 234*e*-234*f* of the cap 202. The protrusions 234*a*-234*f* have a thickened front part allowing the insertion into the hole and securing same therein. Further, the cap mount comprises cup-shaped portions 280*a*-280*d* formed below plates 244*b*, 244*c*, 244*d* and 244*e*. The cups are provided to receive the springs 216*a,b* and 218*a,b* that are guided by cup-shaped portions. The upper parts of the springs 216*a,b* and 218*a,b* are guided by the cup-like portions of the mount 206, and the lower parts of the springs 216*a,b* and 218*a,b* are guided by X-shaped protrusions 282*a*-282*d* formed on a bottom of the support plate 212. The support plate 212 is mounted with a distance d from the cap mount 206 thereby allowing for the bending of the respective portions 206*a* and 206*b* of the cap mount 200 for accommodating for bends or curvatures of the print head as described above.

FIG. 10 shows schematic representations illustrating the movement of a cap assembly 200, e.g. the one shown in FIGS. 7 to 9, from a position of disengagement with the print head to a position capping the print head. In the printer it is assumed that the print head 104 (not shown in FIG. 10) is mounted at a fixed position and the cap assembly 200 is mounted moveably.

FIG. 10(*a*) is an isometric view showing a part of a printer holding the cap assembly 200. FIG. 10(*a*) shows a roller 300 for transporting a recording medium into a print zone of the printer. The roller 300 is resiliently supported (see spring 302) by a frame 304. The frame 304 comprises elongated guide holes 306*a-c* extending from a lower horizontal part via an inclined part to an upper horizontal part. The cap assembly 200 is movably mounted with respect to the frame 304. The pins 254*a-d* of the cap assembly 200 described with regard to FIGS. 7 to 9 are received in the elongated guide holes 306*a-c*. The cap assembly 200 is biased by the springs 308*a-b* towards the position shown in FIG. 10(*a*). FIG. 10(*a*) shows the cap assembly 200 at a capped position where the pins 254 are in the upper part of the holes 306 so that the cap assembly 200 is at en elevated position with regard to roller 300 so that its elastic cap 202 is in engagement with the lower side or surface of the print head for sealing the print head nozzles. FIG. 10(*b*) is a side view of the structure of FIG. 10(*a*) from which the elevated position of the cap 202 can be seen. FIG. 10(*c*) is a side view of the structure of FIG. 10(*a*) with the cap assembly at its at-rest position where the pins 254 are in the lower part of the holes 306 so that the cap assembly 200 is at a lowered position with regard to the roller 300 so that its elastic cap 202 is not in engagement with the lower side or surface of the print head so that printing is allowed.

FIG. 11 shows an example of a printer in which a capping device in accordance with embodiments may be used. FIG. 11 is a schematic representation of a printer 500 having a print head 502 that can be mounted along a rod 504 back and forth to allow printing of characters and the like onto a sheet of paper that is provided on a platen 506 from a paper magazine 508. Printing occurs as the print head reciprocates along the rod 504 and as the sheet is forwarded. Further, the printer 500 comprises a service/maintenance station 510 at the right side of the printer housing 512. The service/maintenance station 510 includes a capping device 514 as described above. As indicated by the arrow, the capping device 514 may be moved from a retracted position into an upward position for capping the print head's nozzles 502*a*.

FIG. 12 shows an example of another printer in which a capping device in accordance with embodiments may be used. FIG. 12(*a*) is a schematic representation of a printer 600 which is a so-called page width printer. The printer comprises a print head 602 extending substantially over a predefined width covering e.g. the width of a sheet of paper provided to a platen 606 from a paper magazine 608, thereby allowing printing onto the paper without a movement of the print head. For capping the print head 602 a capping device 614 as it was described above may be provided. The capping assembly 614 may be engaged with the print head 602 in a way as described in FIG. 10. FIG. 12(*b*) shows the print head 602 with the capping device 614 in position.

The capping device described above may be used with any print head, e.g. the print head of an inkjet printer. The capping device may be used in any kind of printing device, e.g. desktop printers, page width printers, plotters and the like.

While embodiments of a capping device were described in which a vertical movement was required to seal a print head, it is noted that other embodiments may require a movement in a different direction, dependent from an orientation of the print head and its nozzles. E.g. a print head may be mounted at a fixed position with its nozzles directed in a horizontal direction. For such a print head the capping device moves in the horizontal direction. Also, the movement of the capping device may not be linear but may include a rotation for moving the capping device from its rest position to its capping position.

The above described embodiments are merely illustrative for the principles of the capping device. It is understood that modifications and variations of the arrangements and the details described herein will be apparent to others skilled in the art. It is the intent, therefore, to be limited only by the scope of the following claims and not by the specific details presented by way of description and explanation of the embodiments herein.

The invention claimed is:

1. A print head capping device, comprising:

a flexible cap configured to engage with a print head; and a cap mount including a first portion and a second portion, the cap being mounted to the first portion and to the second portion and the first portion of the cap mount and the second portion of the cap mount being moveable with respect to each other.

2. The print head capping device of claim 1, wherein the first portion of the cap mount and the second portion of the cap mount are moveable along an axis extending through the cap and the cap mount.

3. The print head capping device of claim 2, wherein each of the first and second portions of the cap mount include a surface, wherein the cap is mounted to the surface of the first and second portions of the cap mount, and wherein the axis is perpendicular to the surface.

4. The print head capping device of claim 1, wherein the cap mount comprises a third portion, wherein the cap is mounted to the first, second and third portions of the cap mount, and wherein the first, second and third portions of the cap mount are moveable with respect to each other.

5. The print head capping device of claim 1, wherein the cap mount includes a hinge connecting the first and second portions of the cap mount.

6. The print head capping device of claim 5, wherein the hinge comprises a living hinge or a mechanical hinge.

7. The print head capping device of claim 1, wherein the first and second portions of the cap mount are separately and resiliently supported.

8. The print head capping device of claim 1, further comprising a support plate supporting the cap mount.

9. The print head capping device of claim 8, further comprising:

at least one resilient element arranged between the first portion of the cap mount and the support plate, and at least one second resilient element arranged between the second portion of the cap mount and the support plate.

10. The print head capping device of claim 9, wherein the first and second resilient elements comprise a spring.

11. The print head capping device of claim 8, wherein the plate comprises a stop, the stop being configured to limit a movement of the first and second portions of the cap mount to a predefined distance in a direction away from the support plate.

12. A print head capping device, comprising:

a flexible cap configured to engage with a print head; a cap mount including a living hinge between a first portion of the cap mount and a second portion of the cap mount;

a support plate;

a first spring arranged between the first portion of the cap mount and the support plate; and a second spring arranged between the second portion of the cap mount and the support plate, wherein the first and second springs are arranged such that the first and second portions are moveable with respect to each other between a first position distant from the support plate and a second position close to the support plate.

13. A printer, comprising:

a print head; and a print head capping device, the print head capping device comprising:

a flexible cap configured to engage with the print head; and a cap mount including a first portion and a second portion, the cap being mounted to the first and second portions, wherein the first and second portions of the cap mount are arranged moveable with respect to each other.

14. The printer of claim 13, wherein the print head comprises a page width inkjet print head.

15. The printer of claim 13, comprising:

a mechanism configured to move the print head capping device between a first position capping the print head and a second position not capping the print head.

* * * * *